United States Patent [19]

Murray et al.

[11] Patent Number: 4,537,666

[45] Date of Patent: Aug. 27, 1985

[54] DECONTAMINATION USING ELECTROLYSIS

[75] Inventors: Alexander P. Murray, Murrysville; Thomas S. Snyder, Wilkins Township, County, both of Pa.

[73] Assignee: Westinghouse Electric Corp., Pittsburgh, Pa.

[21] Appl. No.: 585,062

[22] Filed: Mar. 1, 1984

[51] Int. Cl.[3] ..... C25F 3/02

[52] U.S. Cl. ..... 204/129.95; 204/140

[58] Field of Search ..... 204/129.1, 129.75, 129.95, 204/130, 140, 153

[56] References Cited

U.S. PATENT DOCUMENTS

| | | | |
|---|---|---|---|
| 3,244,605 | 4/1966 | Hotchkiss | 204/153 |
| 3,459,646 | 8/1969 | Carlson | 204/153 |
| 3,650,925 | 3/1972 | Carlson | 204/153 |
| 4,193,853 | 3/1980 | Childs | 204/129.95 |

*Primary Examiner*—Thomas Tufariello
*Attorney, Agent, or Firm*—R. D. Fuerle

[57] ABSTRACT

Disclosed is a method of decontaminating metal surfaces having a radioactive coating thereon where the coating contains metal ions. An aqueous decontamination solution containing at least one chelate is passed over the coating to solubilize the metals. The decontamination solution is then passed through a porous direct current electrode to reduce the metal ions in the solution and the decontamination solution is again passed over the coating. Also disclosed is an apparatus for decontaiminating metal surfaces coated with radioactive substances. The apparatus consists of a container means for holding an aqueous decontamination solution where the solution contains a chelate, a porous cathode through which the aqueous decontamination solution is passed, and means for circulating the aqueous decontamination solution between the container means, the porous cathode, and the metal surfaces.

6 Claims, 1 Drawing Figure

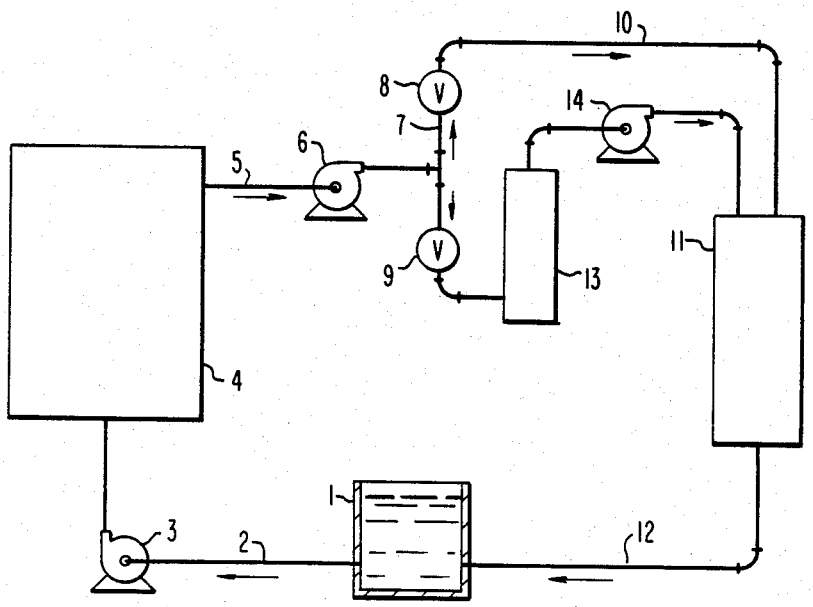
10
8
V
14
7
6
5
11
9
V
13
4
1
3
2
12

DECONTAMINATION USING ELECTROLYSIS

BACKGROUND OF THE INVENTION

Deposits which contain radioactive elements gradually build up in the cooling systems of nuclear reactors. In order to safely maintain and repair the cooling system, it is necessary to remove these radioactive deposits. This is typically accomplished by treating them with an oxidizing solution, such as one containing an alkaline permanganate. This is followed by treatment with a decontamination solution which is an aqueous solution of a chelate, such as ethylenediaminetetraacetic acid (EDTA),and a solubilizing agent, such as a mixture of oxalic acid and citric acid. The chelate forms a complex with the metal ions from the deposits and solubilizes them, and, thus, prevents them from precipitating out of the solution at another location in the cooling system. The decontamination solution is circulated between the cooling system and a cation exchange resin. The chelated metal ions are deposited on the cation exchange resin, freeing the chelate to solubilize additional metal ions in the deposit.

The difficulty with this decontamination process is that both the chelates and the cation exchange resin compete for the metal ions. As a result, the metal ions do not readily leave the chelate and attach themselves to the ion exchange column. This means that long resin contact times are required, and that the ion exchange column effluent may contain relatively high metal ion concentrations. For example, an effluent concentration of about 200 to about 250 ppm of iron and about 20 to about 30 ppm of cobalt is typical for a decontamination solution consisting of 0.2% EDTA, 0.15% citric acid, and 0.15% oxalic acid. Laboratory data indicates that the presence of these metal ions in the ion exchange resin effluent significantly reduces the level to which the cooling system can be decontaminated. The data shows that while a DF (decontamination factor, which is equal to radioactivity before treatment divided by radioactivity after treatment) of about 20 would be obtainable if these metal ions were removed, a DF of about 14 is actually obtained because iron and cobalt are not effectively removed and the solution radioactivity levels remain high.

SUMMARY OF THE INVENTION

We have discovered a method and apparatus for decontaminating metal surfaces using solutions containing chelates which is more effective than prior processes. In the process of this invention the metal ions are removed by passing the decontamination solution through a porous DC electrode. In this way we are able to achieve a higher DF and lower solution radiation levels, which is a substantial advantage in the ease with which the equipment can be handled and disposed of. The process and apparatus of this invention are also faster than prior systems because the lower metal ion concentration produces a faster metal ion dissolution rate from the deposits. As a result, less valuable down time is spent on decontamination.

A further advantage of the invention is that the porous electrode reduces the ferric ion to the ferrous ion, which is much less corrosive. Also, the ferrous ion is a reducing agent and helps to dissolve the metal ions in the lattice by a single electron transfer process, thereby solubilizing the oxides that make up the bulk of the deposits. For example, the ferric ion in the lattice is reduced to the ferrous ion which is more soluble than the ferric ion.

Finally, the removal of the metal ions results in a more uniform dissolution rate of the metal ions in the deposits so there is less corrosion of the metal surfaces in the cooling system and they are less pitted at the end of the decontamination process.

DESCRIPTION OF THE INVENTION

The accompanying drawing is a schematic diagram illustrating a certain presently preferred embodiment of the process and apparatus of this invention.

In the drawing, the decontamination solution in feed tank 1 is forced through line 2 by pump 3 into the apparatus to be decontaminated or a tank containing the apparatus to be decontaminated 4. The decontamination solution is then forced through line 5 by pump 6 into line 7. If valve 8 is open and valve 9 is closed, the solution passes through line 10 into electrolysis unit 11 then back to tank 1 through line 12. If valve 8 is closed and valve 9 is open, the solution is forced through ion exchange column 13 by pump 14 before passing through electrolysis unit 11 and back to feed tank 1.

The process of this invention applies to any decontamination solution which contains a chelate for metal ions. Chelates are complexing agents generally having an equilibrium constant for metal ions of greater than about $10^{18}$. Examples of such chelates include EDTA, trans, 1,2-diaminocyclohexanetetraacetic acid (DCTA), oxybis(ethylenediaminetetraacetic acid) (EEDTA), and nitrilotriacetic acid (NTA). In addition, a typical decontamination solution will also contain one or more solubilizing agents. These are generally weak organic acids, such as citric acid or oxalic acid.

The electrodes used in the electrolysis unit can be made of stainless steel, "Inconel" alloy, nickel, or any other suitable conductor. Stainless steel is preferred as it has good corrosion resistance and is readily available. The electrode must be porous, and is in the form of particles or mesh. Mesh is preferred as it has a higher surface area and a higher electric gradient. If particles are used they can be packed or in the form of a fluidized bed. The electrode is the cathode in the direct current electric circuit of the electrolysis unit.

In the process of this invention the decontamination solution is circulated between the metal surfaces to be decontaminated and the electrolysis unit. It is preferable to pass the decontamination solution through a cation exchange column before it enters the electrolysis unit in order to reduce the concentration of metal ion entering the electrolysis unit. About 1 gallon of the decontamination solution per cubic foot of mesh in the electrolysis unit is a suitable operating parameter, though more or less could also be used. The electrolysis unit is operated using direct current at about 1 to about 10 volts. The temperature of the decontamination solution need not be adjusted, and it will typically be at about 75° to 150° C. The electrode in the electrolysis unit is exhausted when a pressure drop is detected across it and it must then be replaced. The metal ions on the electrode can be recovered, but usually this is not worth the trouble and the contaminated electrode is disposed of as solid waste. If recovery is desired it can be accomplished in an inorganic acid or a strong organic acid.

We claim:

1. A method of decontaminating metal surfaces having a radioactive coating thereon which contains metal ions including ferric ions, comprising:

(A) passing an aqueous decontamination solution containing at least one chelate for said metal ions over said coating to solubilize said metal ions, including said ferric ions;

(B) passing said aqueous decontamination solution through a porous DC electrode to reduce said ferric ions to ferrous ions; and (C) passing said aqueous decontamination solution containing said ferrous ions over said coating.

2. A method according to claim 1 wherein said decontamination solution comprises ethylenediaminetetraacetic acid, oxalic acid, and citric acid.

3. A method according to claim 1 wherein said porous DC electrode is stainless steel mesh.

4. A method according to claim 1 wherein said chelate is selected from the group consisting of ethylenediaminetetraacetic acid, nitrilotriacetic acid, and mixtures thereof.

5. A method according to claim 1 including the additional step of passing said aqueous decontamination solution through an ion exchange column prior to passing it through said porous DC electrode.

6. A method according to claim 2 wherein said decontamination solution contains about 200 to about 250 ppm of iron.

* * * * *